United States Patent [19]

McNeight et al.

[11] Patent Number: 4,463,250

[45] Date of Patent: Jul. 31, 1984

[54] METHOD AND APPARATUS FOR USE AGAINST COUNTERFEITING

[76] Inventors: David L. McNeight, 9, Andrews Close, Tarvin, Cheshire; John G. Lawrence, The Barn, Hollies Lane, Wilmslow, Cheshire, both of England

[21] Appl. No.: 380,713

[22] Filed: May 21, 1982

[30] Foreign Application Priority Data

Jul. 11, 1981 [GB] United Kingdom ..... 8121469

[51] Int. Cl.[3] ..... A63B 71/06

[52] U.S. Cl. ..... 235/385; 235/383; 235/375

[58] Field of Search ..... 235/379, 375, 376, 383, 235/384, 385, 380; 340/825.36, 825.34, 825.54; 364/403

[56] References Cited

U.S. PATENT DOCUMENTS

| | | | |
|---|---|---|---|
| 4,120,452 | 10/1978 | Kimura et al. | 235/381 |
| 4,191,376 | 3/1980 | Goldman et al. | 235/385 |
| 4,340,810 | 7/1982 | Glass | 235/375 |

FOREIGN PATENT DOCUMENTS

| | | |
|---|---|---|
| 0006498 | 1/1980 | European Pat. Off. . |
| 1519256 | 7/1978 | United Kingdom . |
| 1536372 | 12/1978 | United Kingdom . |
| 1554585 | 10/1979 | United Kingdom . |
| 2052819 | 1/1981 | United Kingdom . |

*Primary Examiner*—A. D. Pellinen
*Assistant Examiner*—Robert Lev
*Attorney, Agent, or Firm*—Oblon, Fisher, Spivak, McClelland & Maier

[57] ABSTRACT

A method for use in the detection of fake mass-produced articles that may be apparently identical to genuine articles involves marking genuine articles with a unique or restricted code mark generated by a secret algorithm, the gamut of such marks being underutilized so that attempts to generate seemingly genuine marks without knowledge of the algorithm will stand only a small chance of success. The marks can be scrutinized for genuineness—whether or not they conform to the algorithm—by a programmable hand held calculator or by a computer. Since one way to produce a seemingly genuine mark would be to copy genuine marks, the calculator or computer is also programmed to detect whether any particular mark has been read before.

7 Claims, 3 Drawing Figures

METHOD AND APPARATUS FOR USE AGAINST COUNTERFEITING

This invention relates to measures for use against counterfeiting mass-produced articles.

The most notorious form of counterfeiting is, of course, the production of spurious currency notes and in one aspect the present invention provides methods and apparatus useful in the detection of forged notes, and other forged documents such as driving licences, passports, share bonds, tickets for sporting events and so on. In another aspect, the invention is useful against industrial counterfeiting, in which copies of mass-produced articles such as shirts, pens and other writing implements, spare parts for motor vehicles and bottles of scotch whisky are made to more or less the same quality standards as popular branded products.

Whether such counterfeit goods are of similar quality or inferior as compared to the genuine articles, the manufacturer of genuine articles suffers from a loss of sales—people buy spurious goods who otherwise would have bought the genuine articles. Inferior copies tend to satisfy customers less and future sales may be lost because of a tainted reputation. Special problems arise if faulty or unsatisfactory articles are complained of or "returned" to the genuine manufacturer, but at least this draws attention to the fact that copying is going on. More insidious is the case where copies are made exact in every particular, which not only stand a better chance of acceptance by the customer—thereby making it more worthwhile to continue perpetrating the fraud—but also rule out examination of the goods themselves or their packaging as a means of detecting counterfeiting. The manufacture of spurious though identical articles arises in practice from the growing practice of external, often overseas sourcing of products. It is a simple matter for an external source to produce more articles than contracted for, the overrun being for his own account.

The present invention provides methods and apparatus for use in the detection of counterfeiting that facilitate distinguishing between even such identical genuine and spurious articles.

The invention comprises, in one aspect, a method for use in the detection of fake mass-produced articles that may even be apparently identical to genuine articles, comprising applying to the genuine articles a coded identifying mark generated by a secret algorithm and which is unique for each genuine article or which is applicable to only a small subset of such articles, the algorithm being such that the gamut of marks is underutilised.

The coded identifying mark may comprise a string of numeric characters or of alphabetic characters or of alphanumeric characters.

Advantageously, the mark may be machine-readable and may, for example, comprise a bar code which can be read by a light pen.

The mark may be an attachable label. A convenient way of producing such labels is by printing from a code generating program via a matrix or line printer on to a page of such labels mounted on release paper.

Alternatively, the coded mark may be printed on a regular label such as is usually applied, for example, to a bottle of spirits or perfume.

Where articles are in any event serially numbered, as banknotes, tickets for sporting events and so on, the regular numbering can be adapted so that it is coded according to the invention. In the case of banknotes or travellers' cheques, a machine-readable, coded serial number may also contain an indication of the value of the note or cheque, so that machine-reading the code can be combined with a counting operation.

If desired, the mark may be more permanent—thus, for example, an embroidered or woven label such as is sewn into garments might contain the coded mark, the patterning device for making the label being programmed to produce the different codes as required. Or the mark may be stamped or embossed into a metal or ceramic or plastic article.

Now, to be indistinguishable from a genuine article, a spurious article must have a coded mark on it or on its packaging that is a member of the set of marks generated by the algorithm. Since the algorithm itself is secret (of which more will be said later), the only way a counterfeiter can apply correct marks is by copying existing marks. Since the marks, by the time they become available to the counterfeiter, have been widely dispersed, he cannot hope to see more than a small fraction and he must, therefore, since we are concerned with mass-produced articles, necessarily either use the same mark many times or make the goods with different marks, most of which will not conform to the algorithm.

The problem of detecting spurious articles is now reduced to the problem of detecting marks which do not conform to the algorithm or marks which occur many times when they should only occur once or just a few times.

Just as, with banknotes, the coded mark can contain an indication of the value, so with other products the mark can contain information. For example, a code may contain an indication of the colour or style of a shirt. If the code is found on a shirt of a different style or colour, one is alerted to the possibility of counterfeiting. Or a code may be assigned to a particular sales territory. If it turns up in a different territory, an inquiry is indicated.

Of course, if the coded mark is expressed in alphanumeric characters, they can be read in the ordinary way. Since, again, we are concerned with mass-produced articles that may be dispersed over a wide, even worldwide sales area, policing necessarily involves a number of local inspectors, perhaps quite a large number. Entrusting knowledge of the algorithm, therefore, involves risk of unauthorised disclosure. Better to have the inspectors simply note codes on goods offered for sale and report back to a central computer which analyses the data and shows up wrong or repeated or out of place code marks, thereby indicating areas for more detailed inquiry.

The inspectors can simply write down the codes, or repeat them into a portable tape recorder as they tour retail establishments or other places where the goods in question are offered for sale. With such manual involvement, however, the possibility of errors arises, whether in the initial recording of data or its transcription from the written or spoken record for processing. It may be preferred, therefore, to have the code mark machine-readable, as, for example, a bar code, and to provide the inspectors with a reading device. Such devices already exist in portable form—they are currently used, for example, in stock control operations. The data can be stored in RAM or on tape, and can be forwarded to the central processing establishment either via a telephone or other data link or by mail as appropriate.

Such procedures, however, necessarily involve a certain delay before it has been realised that a counterfeit has or may have been detected. During this delay, of course, the article or articles in question may have been sold so that verification becomes impossible and valuable evidence is lost. The invention also provides, in another aspect, further improved techniques for instantaneously detecting codes which do not conform to the algorithm, or which are in the wrong place, and which may even detect repeated codes.

The invention, in this aspect, comprises adapting code reading equipment to accept a program module to analyse codes as they are input to the equipment and indicate input codes that do not conform to an algorithm contained in the program.

If the equipment also has memory, it may be adapted so that a conforming code which is repeated is also indicated.

Such adapted equipment can still operate in the "reporting" mode, sending daily or weekly returns, for example, of codes read, algorithms compared and so on for analysis. Some of the information gleaned in this way may also be of value to market researchers independently of the possibility of detecting counterfeiting.

Operating in the purely reporting mode, of course, does not involve providing inspectors with knowledge of the algorithm. Supplying to inspectors a program module for instantaneous detection of a wrong code mark involves some risk that such a module could fall into the wrong hands so that the algorithm might be detected. It is, of course, one thing to program a module with an algorithm-comparison program, and quite another thing, given such a module, to deduce the algorithm it is progammed to compare. By making the algorithm sufficiently complicated and/or by making the program module difficult to "read" the inherent risk can be largely eliminated.

However, a further measure can be adopted, which is that the module may be imbued with only partial "knowledge" of the algorithm. Thus it will certainly enable the device to detect wrong code marks, but if its data are extracted to be used in the production of a new set of labels, some of the labels will still be "wrong" to another device. Such other device, of course, might well be the central computer which detects these hitherto undetected wrong codes when the "reporting mode" data are analysed. In any event, a set of codes generated illicitly from a stolen program module would probably be detected through repeating codes.

Inspectors can be provided with a range of program modules to be used for a number of different products. An inspector can thus undertake a "shopping" expedition, examining the different products as they are encountered on what may appear to be a random tour so as not to arouse the suspicions of retailers or others who may themselves have an interest in the supply of counterfeit goods.

It is desirable, to guard against unauthorised disclosure, that as few people as possible have knowledge of the algorithm chosen for a particular product. It is possible, of course, for one man to devise the algorithm and program a computer to produce the codes, and also to have the same computer program, in turn, to program modules to be used in detecting wrong codes. However, the smallest number of people that need to have knowledge of the algorithm is none, and this also is possible by having a computer itself generate an algorithm.

The algorithm may generate code numbers in a manner akin to the way the German Patent Office generates check digits assigned to patent application numbers. (Here the object is to ensure that errors in transcribing the numbers stand a chance of being discovered).

Serial numbers of the form "abcdefg" are modified by the addition of a decimal "h" where "h" is calculated from an expression "pa+gb+rc+sd+te+uf+vg", and taking the most significant, or the least significant figure. However, whereas in the generation of check digits it is desirable to identify the check digits as such so that the serial number can readily be ascertained, in the present invention, the "check digit" can be assigned to a different position in the number where it is less conspicuous. If there is only one "check digit" generated by the algorithm, any illicitly generated number stands an 0.1 chance of conforming to the algorithm accidentally. If two "check digits" are used, this chance falls to 0.01.

While normal check digit generating algorithms are designed to show up the more usual types of transcription error (transposition of adjacent digits, repeating one digit instead of another, as in writing "886" for "866", and so on) the principles behind the generation of identifying codes for the purposes of the present invention should, rather, ensure that the algorithm cannot reasonably be deduced from a knowledge of a few genuine code marks. Trivial algorithms such as "all even numbers are valid" would be less satisfactory than more complicated rules such as "all ten-digit even numbers with their fourth digit divisible by three and their seventh digit odd and all ten digit odd numbers with their third digit even and their fourth and fifth digits differing by one", which would be considerably more difficult to figure out from even quite a large sample of genuine numbers—and, of course, the larger the sample required, the more difficult it is to collect together.

Embodiments of apparatus and methods for use against counterfeiting mass-produced articles according to the invention will now be described with reference to the accompanying drawings, in which.

Figure 1:
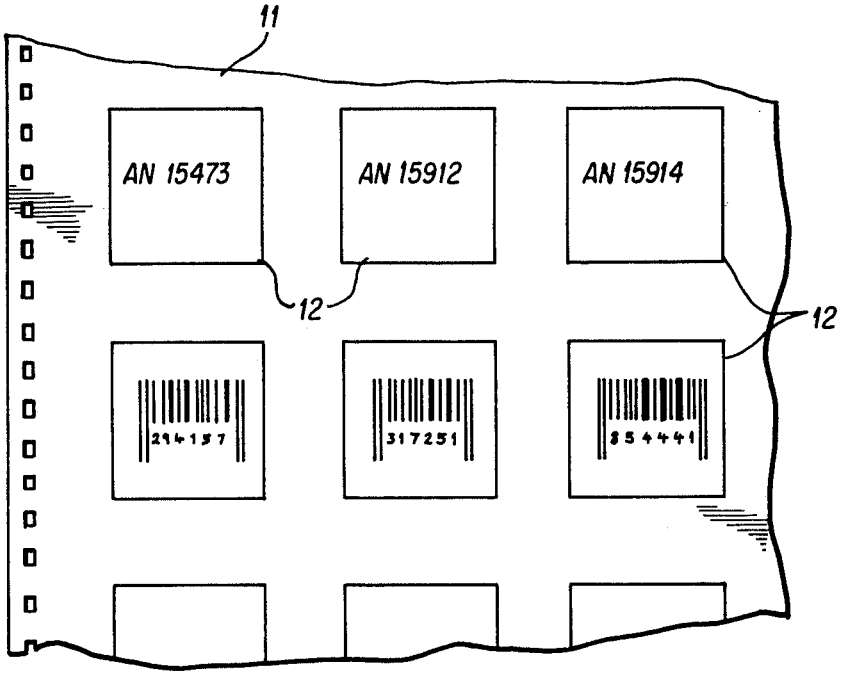
FIG. 1 shows part of a sheet of peel-off labels printed by a computer.

The sheet 11 of peel-off labels 12, shown in FIG. 1 could be produced on a dot-matrix printer or a line printer attached to a computer generating the numbers on the labels according to an algorithm, if the labels 12 have only alphanumeric characters as shown in the top row. Labels of different types, as the first and second rows, would probably not be printed on the same sheet in practice. If the labels also have bar codes as shown in the second row, a special bar code printer may be required. (The bar codes illustrated are merely digrammatic and are not intended to be an accurate depiction of actual bar codes).

The sheets of labels could be held by the proprietor of the trade mark rights in the goods and applied by him prior to distributing the goods supplied to him by subcontractors, or sufficient sheets may be supplied only for the number of articles contracted for, so that the labels can be applied at source in the event that the goods do not pass through the hands of the proprietor before distribution—as may happen, for example, with goods produced at the order of a British company in Hong Kong for shipment to Australia. There is a risk that the manufacturer, in order to produce an overrun, could photocopy the labels; but in doing so would risk exposure by the detection of a single instance of duplication.

Figure 2:
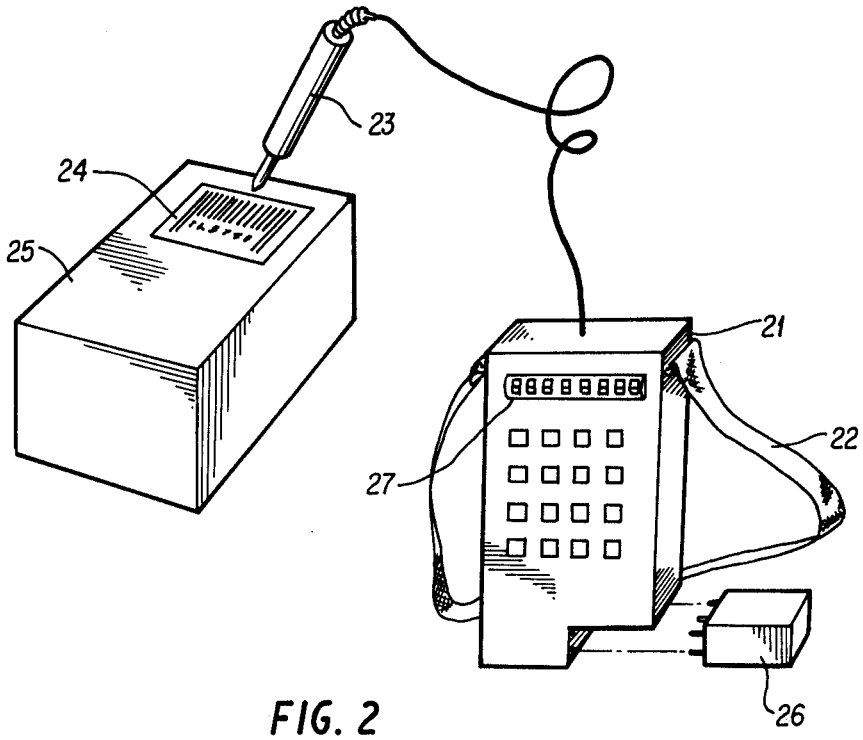
FIG. 2 shows a bar code label and a reader, therefor with plug-in program module.

FIG. 2 shows a by now fairly conventional portable bar code reader 21 on a shoulder strap 22 with a light pen 23 for reading bar codes such as the one on the label 24 on a package 25 for an article protected by the invention. The reader 21 has a keyboard by which data and instructions can be input, and a plug-in module 26 is provided carrying a program (e.g. in a PROM or a hard-wired chip, or on a magnetic card) for discriminating between good and wrong code marks.

Such code readers could be distributed among a national, preferably international network of inspectors, who would inspect goods on offer for sale according to instructions from a central command as described above.

In addition, the reader 21 is provided with a RAM or a magnetic tape recorder for recording all data and instructions input to the reader. When a tape is full, or at regular intervals, it is detached and mailed back for analysis, and a fresh one substitued. When a RAM is full, or at regular intervals, its data is read off and sent back electronically. The keyboard input can be used for additional market information such as prices, location of point of sale, as well as for essential information about the inspector, date and time and so on as required.

The reader 21 also has an LED or LCD display 27 on which a code being read is displayed in appropriate alphabetic and/or numeric characters together with an indication that it is a wrong code, if it is, and the reason.

Figure 3:
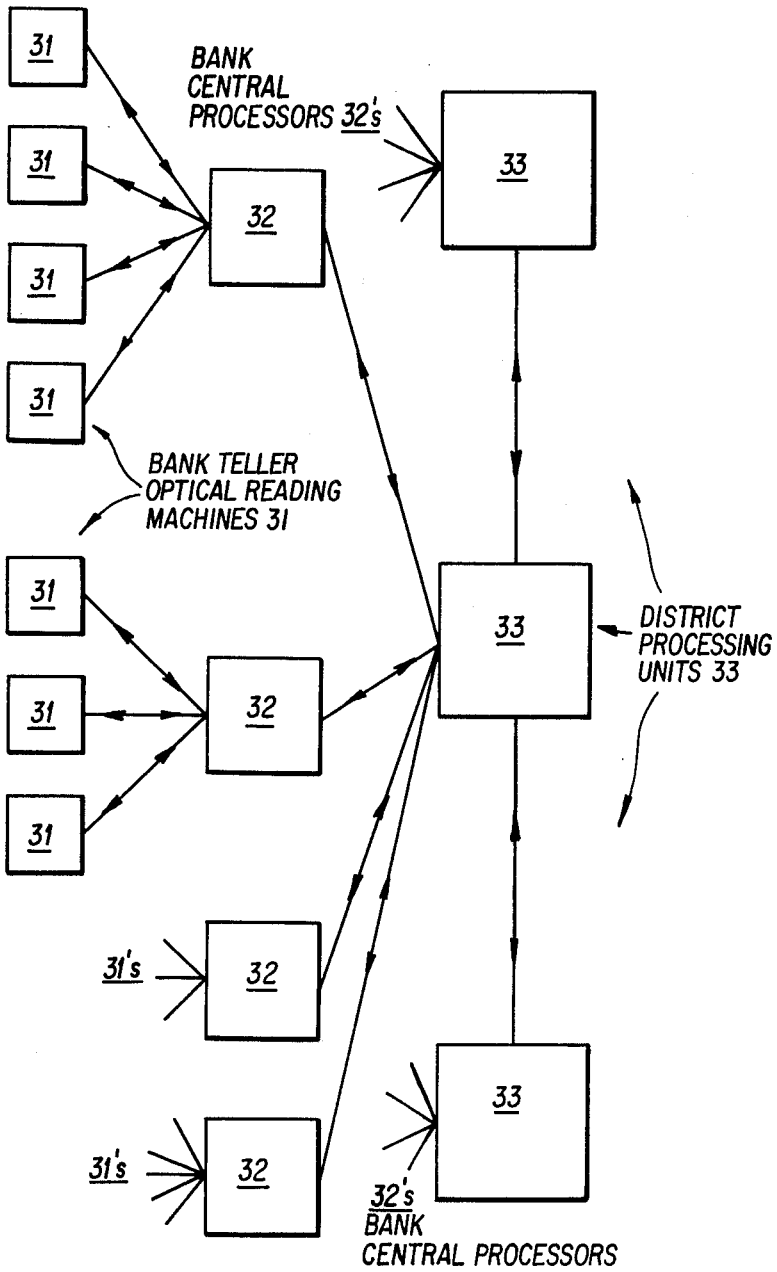
FIG. 3 is a diagrammatic illustration of a system for handling currency notes.

FIG. 3 illustrates a system for use in connection with bank notes. Each bank teller has an optical reading machine 31 connected to a central processor 32. The processor carries in memory all the algorithms appurtaining to notes in circulation, these being supplied by the appropriate issuing authority as PROM or magnetic card or tape or otherwise as convenient.

Banknotes in circulation in the United Kingdom carry a ten digit alphanumeric serial number, which, as currently constituted, is of no value for the prevention of counterfeiting according to the present invention, but if made to conform to an algorithm (which may require the addition of two extra digits, or the use of a greater proportion of alphabetic characters) and made machine-readable by being expressed in bar form, would serve for that purpose as well as enabling automatic counting, by including a digit denoting the value.

Forged banknotes will either have to risk having a wrong code, which will be instantly identified when the note is passed at a bank, or will have to be numbered with codes known to be correct. Such codes can, of course, be taken from genuine notes, but if repetition is to be reasonably avoided, as many genuine notes must be copied from as spurious notes are to be produced, which will put the forgers to a great deal of trouble.

It is suggested that the apparatus provided for banks be provided with memory like that of the portable apparatus described with reference to FIG. 2, but on a larger scale, and that this be provided in a processing unit 33 central to the banks of a town or district. The central processors of each bank can report the codes of notes passed to the district processing unit, which can store the codes for a predetermined period of time—say one week—and report back to the bank and indeed to the teller to whom the note was passed.

Data processing equipment at relatively modest prices can handle several hundred megabytes of storage on hard disc, which will handle transactions for a district-sized group of banks.

District processing units 33 can talk to each other out of banking hours to check for duplicated notes nationwide. If any such is discovered, the code thereof can be put into special memory in the central processing unit of every bank to be available to stall further attempts to pass the same notes or notes with the same code.

For relatively modest cost, these measures should effectively limit the freedom of counterfeiters to pass forged notes in any quantities and may ultimately render forgery unprofitable.

Other monetary notes, such as travellers checks, can be treated in the same way.

A further interesting application of the techniques according to the invention may lie in the policing of licences granted hereunder. Licensees may be required to incorporate certain secret algorithms into their own algorithms. In this way, the use of unlicensed algorithms can be detected, and will presumably thereby be deterred.

We claim:

1. A method for identifying genuine mass-produced articles from fake articles comprising the steps of applying to said genuine articles an open identifying mark generated by a secret algorithm which mark is unique for a particular small subset of articles taken from a set consisting of all such genuine articles marked according to the algorithm, the mark being selected from a set of such marks, which set is itself a small subset of a set of all possible such marks which can be generated by the algorithm, so that the probability of unauthorized identification of a mark that belongs to the said particular small subset of marks is small, and subsequently inspecting articles to distinguish genuine articles from fake articles which bear fake identifying marks by:

(a) testing a sample of applied marks attached to articles to be identified to determine if said applied marks correspond with the secret algorithm; and (b) comparing thus tested and applied marks which correspond with the secret algorithm against previously tested marks to determine if there is a higher incidence of repeated marks in the sample than would be expected from the relative sizes of the particular small sub-set of articles identically marked and the set of all genuine articles marked according to the algorithm.

2. A method according to claim 1, in which the said particular small sub-set of articles comprises a single article so that each article bears a unique mark and any repeated mark indicates that one at least of the articles bearing the repeated mark is fake.

3. A method according to claim 1, in which said identifying mark comprises a string of alphanumeric characters.

4. A method according to claim 1, in which said identifying mark comprises a string of machine-readable characters.

5. A method according to claim 1, in which said identifying mark comprises a bar code.

6. A method according to claim 1, in which a programmable, hand-held electronic calculator is used to determine whether a mark purporting to be genuine conforms to the secret algorithm and to store all marks examined and to check for repeated marks.

7. A method according to claim 6, in which data is periodically transferred from said calculator to a computer capable of storing larger numbers of tested marks than said calculator and the computer examines the marks it stores for repeated marks.

* * * * *